US009879935B2

(12) United States Patent
Maffett

(10) Patent No.: US 9,879,935 B2
(45) Date of Patent: Jan. 30, 2018

(54) QUICK TAKE-DOWN FIREARM

(71) Applicant: Michael Lance Maffett, Rome, GA (US)

(72) Inventor: Michael Lance Maffett, Rome, GA (US)

(73) Assignee: Leo Takedown, LLC, Rome, GA (US)

( * ) Notice: Subject to any disclaimer, the term of this patent is extended or adjusted under 35 U.S.C. 154(b) by 0 days.

(21) Appl. No.: 15/357,538

(22) Filed: Nov. 21, 2016

(65) Prior Publication Data

US 2017/0284760 A1 Oct. 5, 2017

Related U.S. Application Data

(60) Provisional application No. 62/314,758, filed on Mar. 29, 2016.

(51) Int. Cl.
*F41A 21/48* (2006.01)
*F41A 5/26* (2006.01)
*F41A 3/66* (2006.01)

(52) U.S. Cl.
CPC ..... *F41A 21/48* (2013.01); *F41A 3/66* (2013.01); *F41A 5/26* (2013.01); *F41A 21/484* (2013.01); *F41A 21/485* (2013.01)

(58) Field of Classification Search
CPC ..... F41A 21/00; F41A 21/48; F41A 21/481; F41A 21/482; F41A 21/484; F41A 21/485; F41A 21/488
USPC ..... 89/125, 179, 191.01, 191.02, 192, 193, 89/194; 42/75.01, 75.02, 75.1
See application file for complete search history.

(56) References Cited

U.S. PATENT DOCUMENTS 2,625,766 A 1/1953 Simpson
3,181,262 A * 5/1965 Bridge, Sr. ..... F41A 21/40 42/112
3,667,343 A * 6/1972 Jurkowski ..... F41A 7/10 89/161
4,546,564 A 10/1985 A'Costa
4,920,679 A * 5/1990 Sarles ..... F41A 21/481 42/75.02
5,433,133 A 7/1995 La France
5,509,345 A 4/1996 Cyktich
5,559,302 A 9/1996 Latka
5,685,102 A 11/1997 Latka
5,987,797 A 11/1999 Dustin
(Continued)

OTHER PUBLICATIONS

New DOLOS System from Huntertown Arms, The Firearm Blog, http://www.thefirearmblog com/blog/2016/03/31/new-dolos-system-from-huntertown-arms, Posted Mar. 31, 2016, (Admitted Prior Art), 7 pages.

*Primary Examiner* — Bret Hayes
(74) *Attorney, Agent, or Firm* — Kilpatrick Townsend & Stockton LLP

(57) ABSTRACT

Quick take-down firearms and methods of using quick-take down firearms. The quick-take down includes an upper receiver coupling and a barrel coupling. The quick take-down can be unlocked by sliding a sliding lock collar in a translational motion to an unlocked position to release locking elements from a locked configuration. In the unlocked position, a barrel and handguard may be installed onto and removed from the upper receiver of the firearm. Releasing the sliding lock collar returns it to a locked position, securing the barrel and handguard to the upper receiver.

20 Claims, 14 Drawing Sheets

(56) References Cited

U.S. PATENT DOCUMENTS

| | | | | |
|---|---|---|---|---|
| 6,273,080 | B1 | 8/2001 | Sullivan, Jr. | |
| 6,655,372 | B1 | 12/2003 | Field et al. | |
| 6,959,509 | B2 | 11/2005 | Vais | |
| 7,076,904 | B1 | 7/2006 | Rustick | |
| 7,353,740 | B1 | 4/2008 | Hoffman | |
| 7,574,823 | B2 | 8/2009 | Nakayama | |
| 7,610,710 | B2 | 11/2009 | Brittingham | |
| 7,676,976 | B2 | 3/2010 | Dueck et al. | |
| 7,721,639 | B2 | 5/2010 | Wössner | |
| 7,946,059 | B2 | 5/2011 | Borel | |
| 8,291,805 | B1 | 10/2012 | Quilligan | |
| 8,479,429 | B2 | 7/2013 | Barrett et al. | |
| 8,490,312 | B2 | 7/2013 | Barrett et al. | |
| 8,505,227 | B2 | 8/2013 | Barrett et al. | |
| 8,607,490 | B1 | 12/2013 | Zinsner | |
| 8,689,478 | B2 | 4/2014 | Patel | |
| 8,769,853 | B1 | 7/2014 | LaRue | |
| 8,782,943 | B2 | 7/2014 | Jarboe | |
| 8,839,545 | B1 | 9/2014 | Gangl et al. | |
| 8,863,426 | B1 | 10/2014 | Zinsner | |
| 8,910,746 | B1 | 12/2014 | McKenzie | |
| 8,997,621 | B1 | 4/2015 | Dater et al. | |
| 9,057,576 | B2 | 6/2015 | Barrett et al. | |
| 9,121,656 | B1 | 9/2015 | McKenzie | |
| 9,175,919 | B2 | 11/2015 | Russell et al. | |
| 9,228,786 | B2 | 1/2016 | Sulllivan et al. | |
| 9,234,717 | B2 | 1/2016 | Jarboe | |
| 9,383,156 | B2 | 7/2016 | Steimke et al. | |
| 9,448,027 | B1 | 9/2016 | Zinsner | |
| 2006/0277810 | A1* | 12/2006 | Leitner-Wise | F41A 3/66 42/75.03 |
| 2007/0095198 | A1* | 5/2007 | Dater | F41A 21/325 89/14.2 |
| 2015/0198403 | A1* | 7/2015 | Bentley | F41A 21/484 42/75.02 |
| 2015/0308779 | A1 | 10/2015 | McGinty | |
| 2016/0033225 | A1 | 2/2016 | Selvetti | |
| 2016/0054096 | A1* | 2/2016 | Dzwill | F41C 23/16 42/75.02 |
| 2016/0102935 | A1 | 4/2016 | Young | |
| 2016/0116251 | A1 | 4/2016 | Mather et al. | |
| 2016/0209155 | A1 | 7/2016 | Dodson | |
| 2017/0160037 | A1* | 6/2017 | Gray | F41A 21/482 |

* cited by examiner

QUICK TAKE-DOWN FIREARM

CROSS-REFERENCE TO RELATED APPLICATIONS

This patent claims the benefit of and incorporates in its entirety U.S. provisional patent application No. 62/314,758, filed Mar. 29, 2016 for a "Straight-in, rifle barrel attachment & detachment using a ball bearing positive lock."

BACKGROUND

AR-15, M4, M16 and similar prior art MILSPEC rifles cannot be quickly disassembled and reassembled where the rifle barrel connects to the upper receiver, a process which usually requires the use of specialized tools and a work-bench equipped with a vise. While there are some prior art systems that allow for in-field tool-less disassembly and reassembly of the barrel from the upper receiver, these systems are not effective or robust, are complicated to use, and do not allow for use of standard MILSPEC had guards and other accessories commoly used with these types of firearms.

SUMMARY

This patent is for quick-take down firearms and methods of using quick-take down firearms.

In one non-limiting example, the quick-take down includes an upper receiver coupling configured to be secured to an upper receiver threading of the firearm, the upper receiver coupling including several rotationally offset gas tube tunnels extending through the upper receiver coupling; further includes a rifle barrel coupling configured to be secured to a barrel of the firearm; and further includes a sliding lock collar configured to be slid in a translational motion between a locked position and an unlocked position, the sliding lock collar biased to the locked position; when the sliding lock collar is in the unlocked position the barrel of the firearm can be removed from and installed on the upper receiver; when the sliding lock collar is in the locked position and the barrel is installed on the upper receiver the upper receiver coupling is secured to the rifle barrel coupling thereby securing the barrel to the upper receiver.

In one non-limiting example, a method of assembly for a quick take-down firearm includes: sliding a sliding lock collar in a translational motion to an unlocked position to release a plurality of locking elements from a locked configuration, in which the sliding lock collar is biased away from the unlocked position towards a locked position; next, while the sliding lock collar is held at the unlocked position, inserting a barrel of the firearm into an upper receiver of the firearm, in which an upper receiver coupling is secured to threading of the upper receiver, the upper receiver coupling comprising a gas tube tunnel extending through a body of the upper receiver coupling and a barrel coupling is secured to the barrel; next inserting the barrel into the upper receiver further comprises inserting a barrel pin of the barrel into a notch of the upper receiver threading, and inserting a gas tube of the barrel through the gas tube tunnel of the upper receiver coupling; and next, after inserting the barrel into the upper receiver, releasing the sliding lock collar such that it slides in the translational motion to the locked position to secure the upper receiver coupling to the barrel coupling.

DETAILED DESCRIPTION OF DRAWINGS

Figure 1:
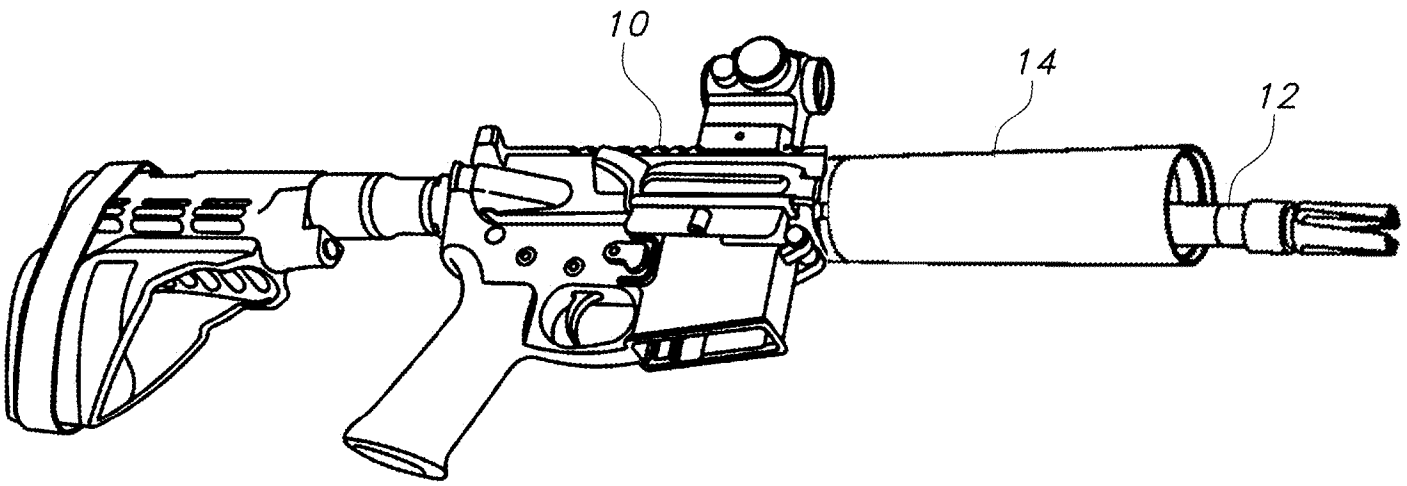
FIG. 1 (PRIOR ART)
FIG. 1 shows an example of a prior art firearm.
Figure 2:
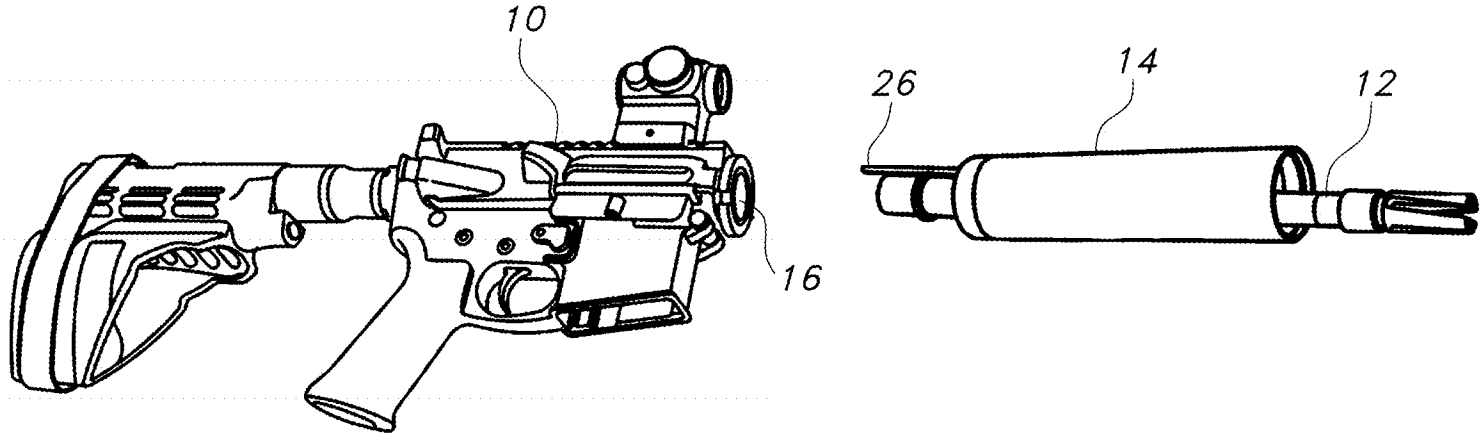
FIG. 2 (PRIOR ART)
FIG. 2 shows the firearm of FIG. 1 with the barrel and handguard disassembled from the upper receiver.

FIGS. 1 and 2 show a prior art firearm, which, in this example, is an AR-15. The quick take-down couplings described in this patent are not limited to use with AR-15's, however, and may be used with a wide variety of firearms where it may be desirable to be able to quickly take down and assemble a firearm. As non-limiting examples, the quick take-down couplings of this patent may also be used with M4's, M16's, and similar MILSPEC rifles.

The firearm of FIGS. 1 and 2 includes an upper receiver 10, a barrel 12, and a handguard 14. FIG. 1 shows the firearm assembled with the barrel 12 and handguard 14 attached to the upper receiver 10. FIG. 2 shows the firearm disassembled with the barrel 12 and handguard 14 removed as a unit from the upper receiver 10.

Figure 3:
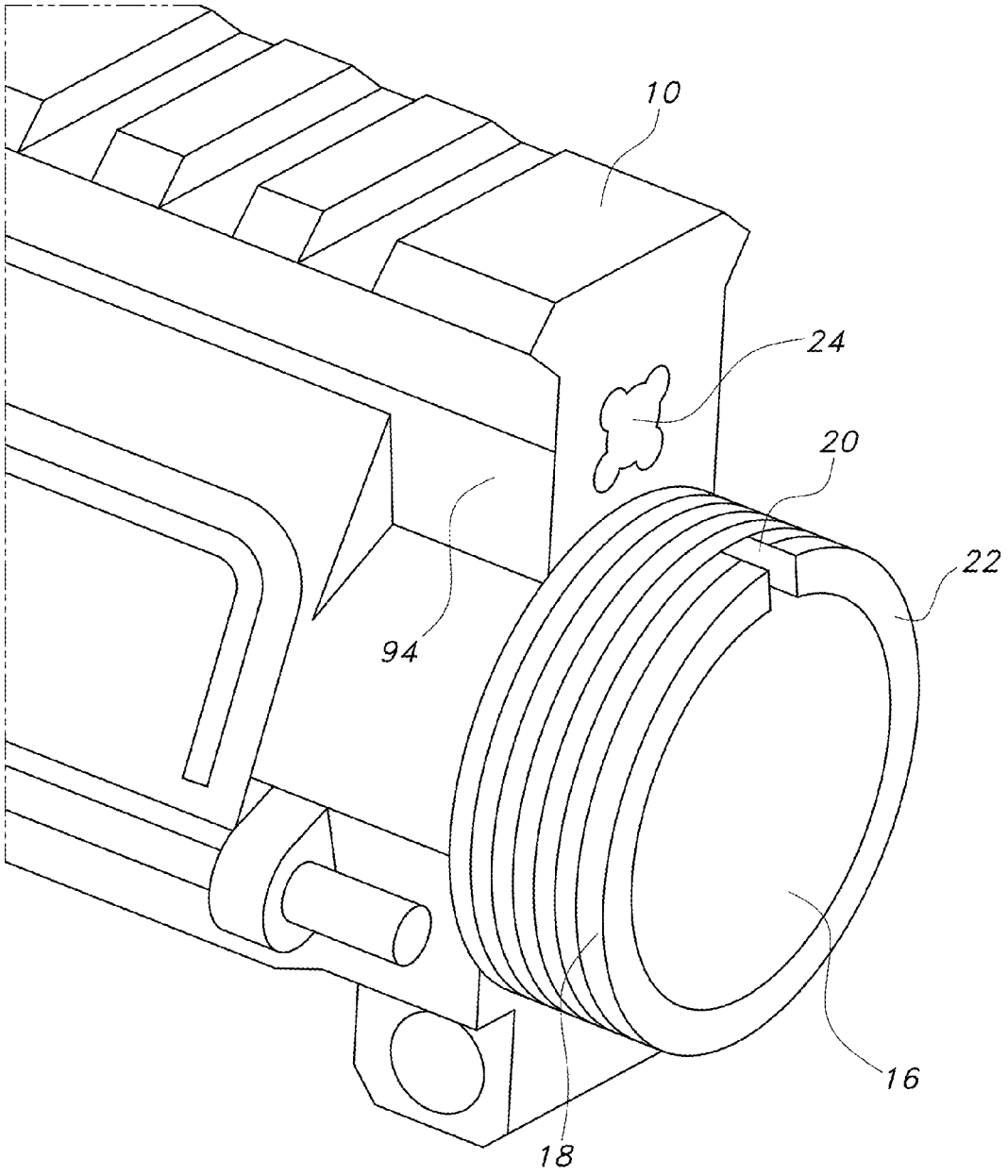
FIG. 3 (PRIOR ART)
FIG. 3 shows the upper receiver of the firearm of FIG. 1 in more detail.

FIG. 3 shows in more detail an example of a prior art upper receiver 10. The upper receiver 10 includes an opening 16 for receiving an end of the barrel 12, threads 18 surrounding the opening 16, a notch 20 in the threads 18, and reference surface 22 (e.g. the shoulder where threading 18 ends). FIG. 3 also shows another opening 24 in the upper receiver 10 for receiving a gas tube or piston that facilitates cycling of the firearm (FIG. 2 shows a gas tube 26).

Figure 4A:
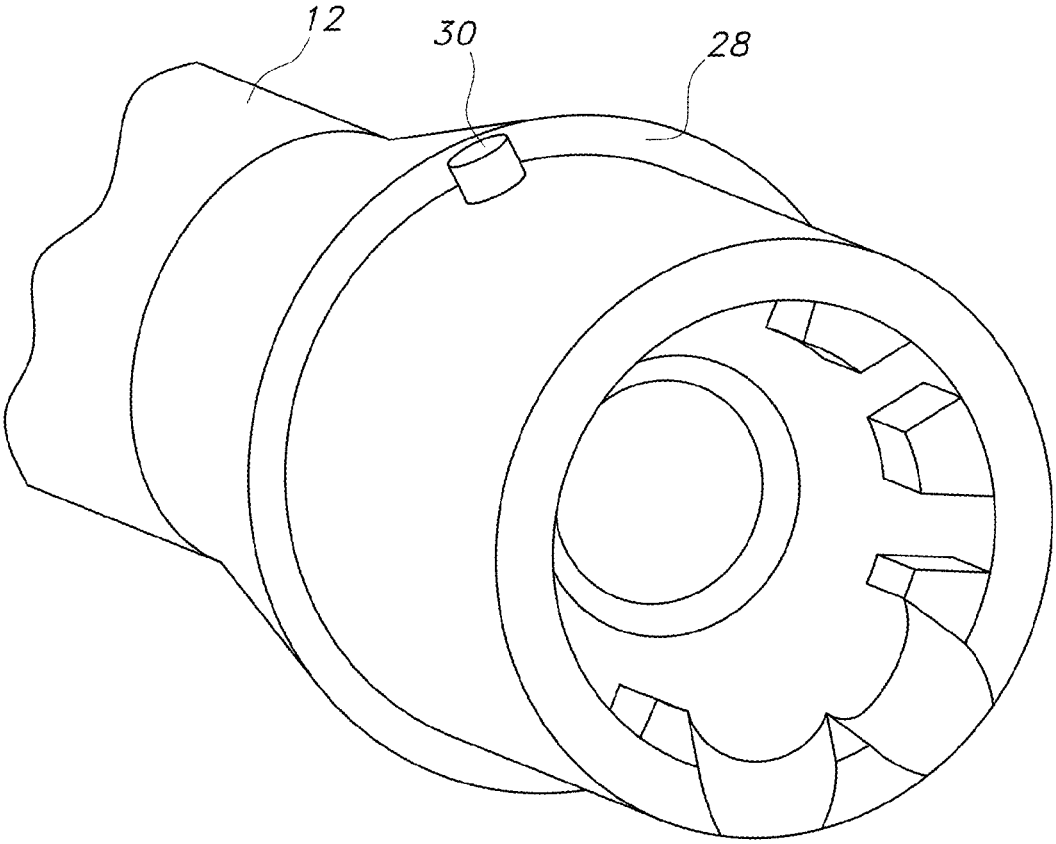
FIG. 4A (PRIOR ART)
FIGS. 4A-B show and end of the barrel of the firearm of FIG. 1 in more detail.
Figure 4B:
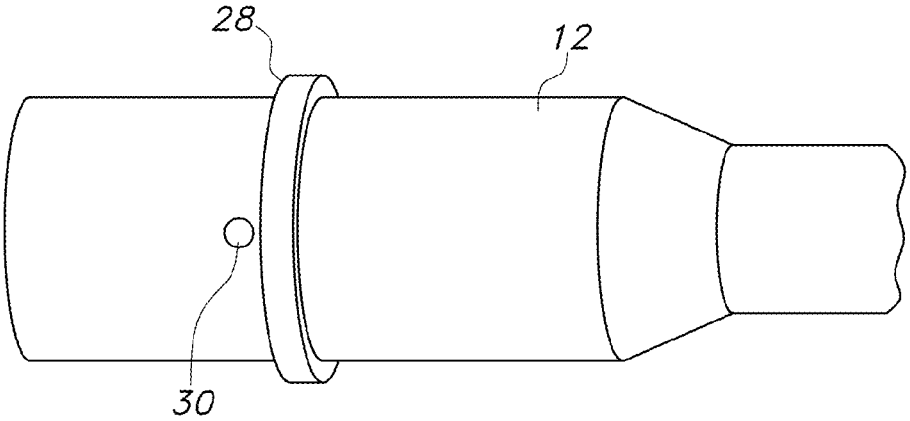
FIG. 4B (PRIOR ART)
Figure 5A:
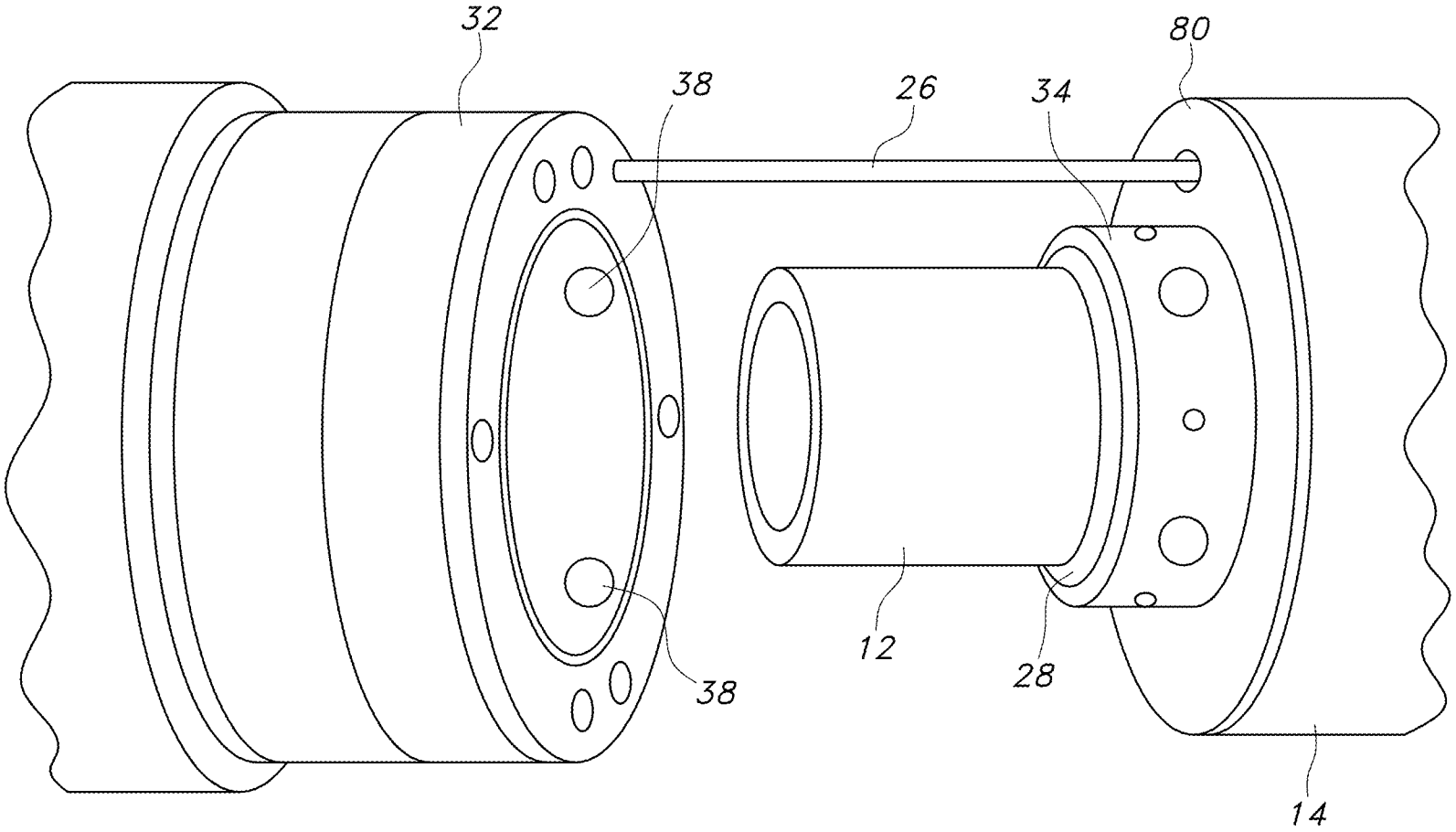
FIG. 5A schematically shows an example of a quick take-down coupling installed on a firearm.
Figure 5B:
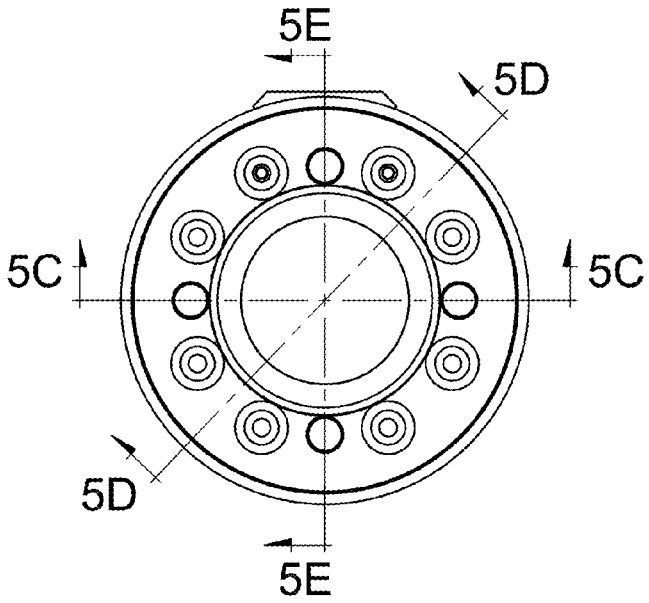
FIGS. 5B-E show end and cross-sectional views of the quick take-down coupling of FIG. 5A.
Figure 5E:
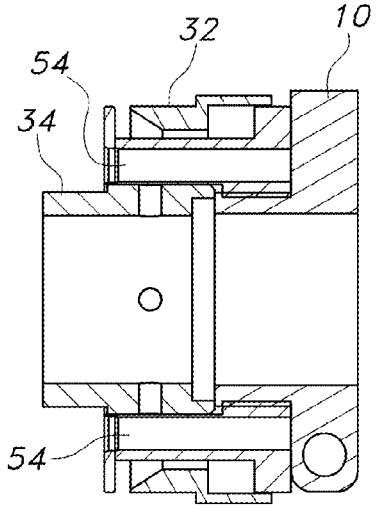
Figure 5C:
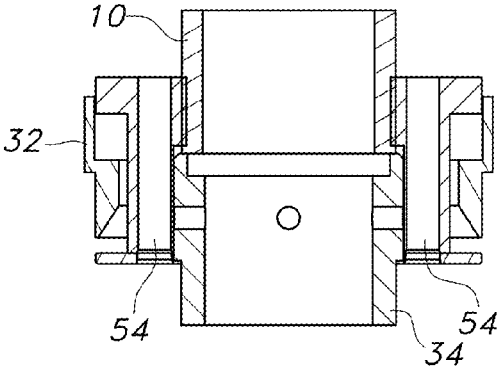
Figure 5D:
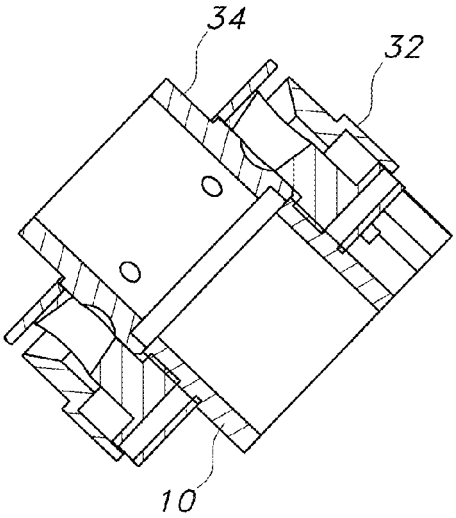

FIGS. 4*a* and 4*b* show in more detail an example of a prior art barrel 12. The barrel 12 includes on its outer surface a reference surface 28 (e.g. a ridge extending around the barrel) and a pin 30.

In the prior art, the barrel 12 was attached to the upper receiver 10 by inserting the end of the barrel 12 into the upper receiver's opening 16 until the barrel reference surface 28 contacted the reference surface of the upper receiver 22 and the pin 30 was fully seated in the notch 20. Next, a barrel nut (not shown) would be threaded onto the threads 18 of the upper receiver 10 to secure the barrel 12 in the opening 16. A handguard (e.g. such as handguard 14 shown in FIGS. 1 and 2) could be secured by threading the handguard onto exterior threads of the barrel nut or in other manners.

Quick Take-Down Coupling Example

FIGS. 5*a*-5*e* show an example of a quick take-down coupling that can be used with the firearm of FIGS. 1-4 to provide quick and easy installation and removal of the barrel from the upper receiver. The quick take-down coupling of FIGS. 5*a*-e includes an upper receiver coupling 32 and a barrel coupling 34. The upper receiver coupling 32 secures to the threads 18 of the upper receiver. The barrel coupling 34 secures to the barrel 12 proximate the reference surface 28 and pin 30. The quick take-down coupling has a locking mechanism, described in further detail below, for locking and unlocking the upper receiver coupling 32 from the barrel coupling 34, providing for quick and easy installation and removal of the barrel 12 from the upper receiver 10. FIGS. 5*a*-5*e* provide a general overview of the upper receiver coupling 32 and barrel coupling 34 components, and do not show all of the individual elements of those components.

Figure 6:
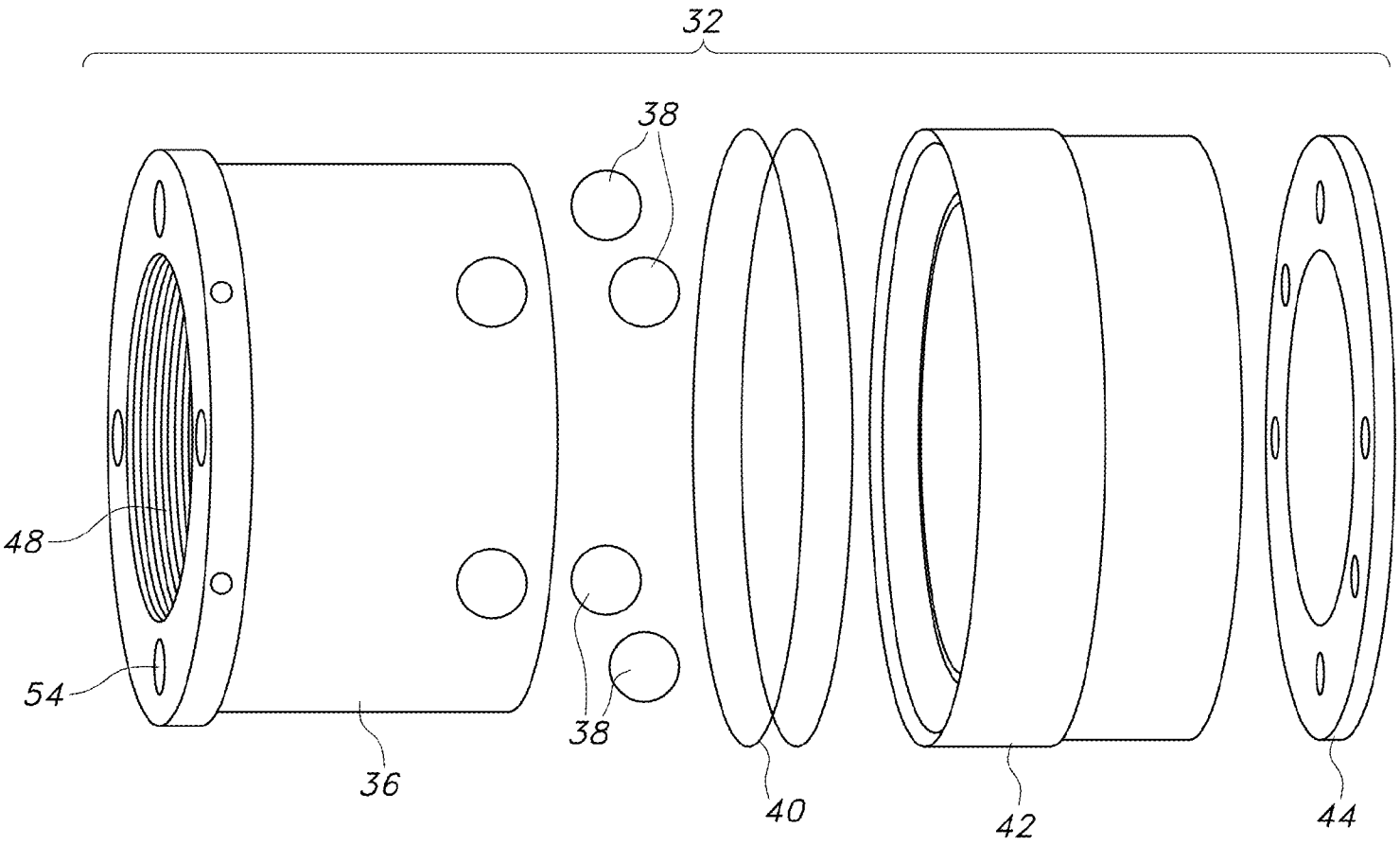
FIG. 6 shows an example of an upper receiver coupling component in a disassembled condition.

FIGS. 6 through 9 show the upper receiver coupling 32 of FIG. 5 in further detail. Referring to FIG. 6, the upper receiver coupling 32 includes, from left to right, a body 36, locking elements 38, resilient element 40, sliding lock collar 42, and face plate 44. The resilient element 40 is shown in FIG. 6 as a coil spring, although other types of resilient elements may be used, such as a wave spring.

FIGS. 7A-D show the body 36 of FIG. 6 in further detail. The body 36 includes an opening 46 extending through it from one end to the other. At least a portion of the opening 46 includes interior threading 48 (see FIG. 6) which is configured to engage the exterior threading 18 of the upper receiver 10. In other words, the pitch, thread angle, major diameter, minor diameter, etc. of the threading 48 of the body 36 is configured to correspond with the pitch, thread angle, major diameter, minor diameter, etc. of the threading 18 of the upper receiver 10. In some embodiments, the body threading 48 is MILSPEC or other standardized threading allowing it to be installed on a wide variety of commercially available firearms. The body 36 of FIGS. 7A-D also includes through holes 50 around the perimeter of the body 36 for receiving set screws or similar items to further secure the upper receiver coupling 32 to the upper receiver threads 18. In some embodiments, the set screws used may be nylon or another relatively soft material to lessen the risk of damaging the upper receiver threads 18.

The body 36 of FIGS. 7A-D further includes apertures 52 spaced around the body 36 configured to receive locking elements 38 (e.g. ball bearings) such that portions of the locking elements may protrude into the opening 46 of the body 36 when the upper receiver coupling 32 is in a locked configuration (discussed further below). As shown in FIG. 7D, the apertures taper so that, in cooperation with the shape of the locking elements 38, the amount of penetration of the locking elements 38 into the opening 46 is limited.

Figure 7A:
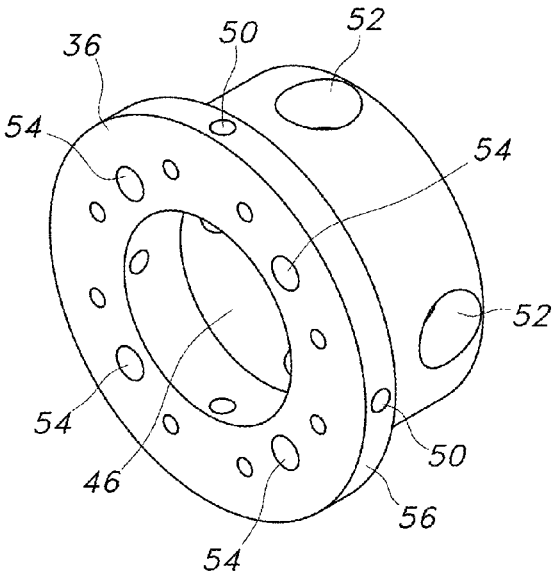
FIGS. 7A-D show an example of a body of an upper receiver coupling component.
Figure 7B:
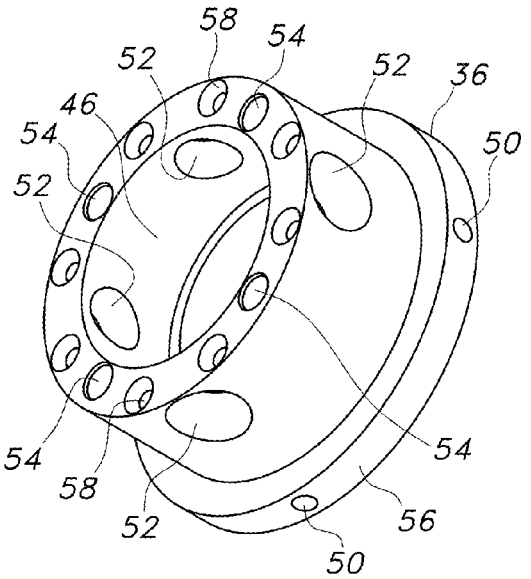
Figure 7C:
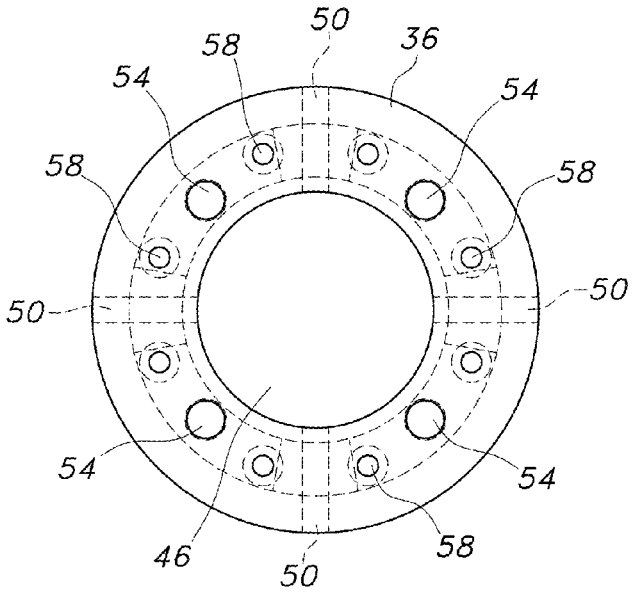
Figure 7D:
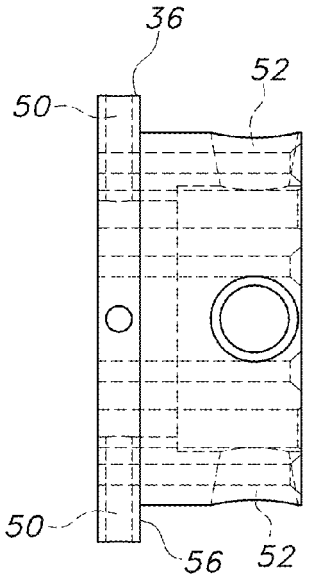

The body 36 of FIGS. 7A-D further includes several tunnels 54 extending through the length of the body from one end to the other. The tunnels 54 are configured to allow passage of a gas tube or piston associated with the barrel 12 through the body 36 and into the opening 24 on the upper receiver. As shown in FIGS. 7A-C, the tunnels 54 are rotationally offset from one another (in this example, there are four tunnels 54 spaced apart 90 degrees from adjacent tunnels 54) and also rotationally offset from the apertures 52 in the body 36. In this example, the tunnels 54 are rotationally offset to allow for proper alignment of one of the tunnels 54 with the opening 24 in the upper receiver 10 when the upper receiver coupling 32 is secured to the upper receiver threads 18 at a desired torque or within a desired torque range.

The body 36 of FIGS. 7A-D further includes a flange or shoulder 56 and openings 58, the purposes of which will be described further blow.

Figure 8A:
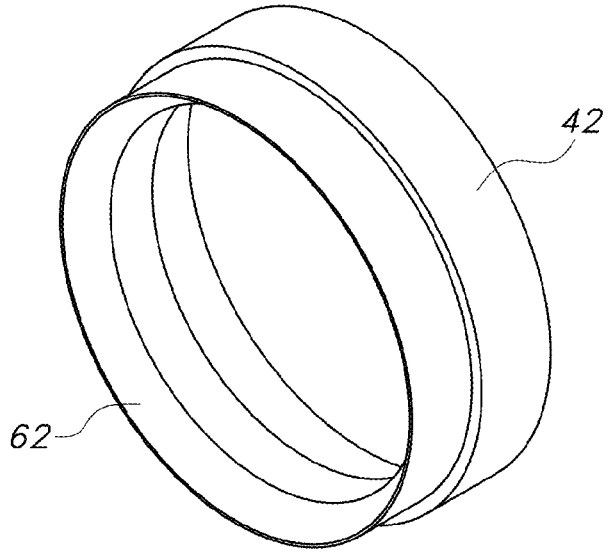
FIGS. 8A-C show an example of a sliding lock collar of an upper receiver coupling component.
Figure 8B:
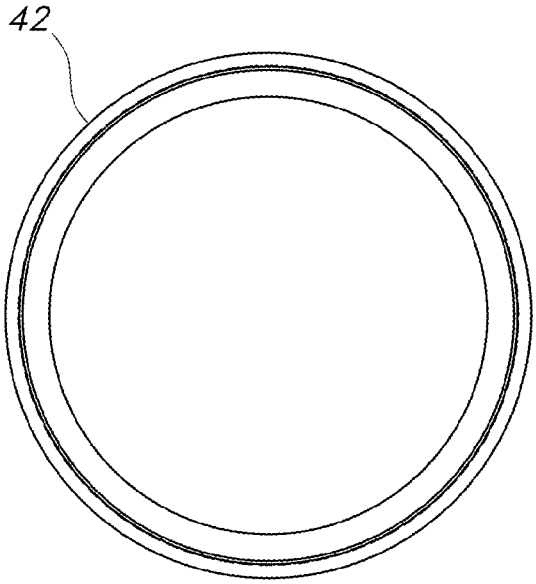
Figure 8C:
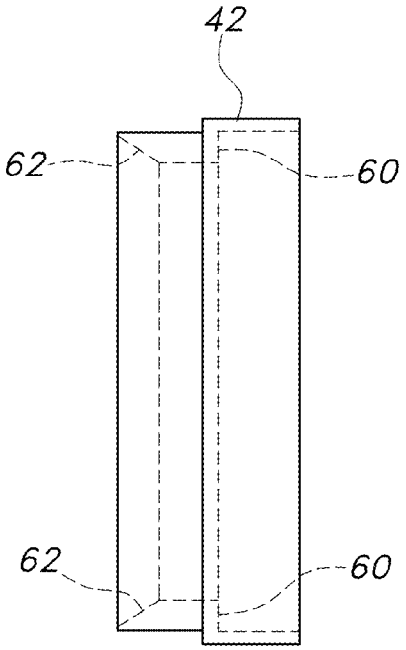
Figure 8D:
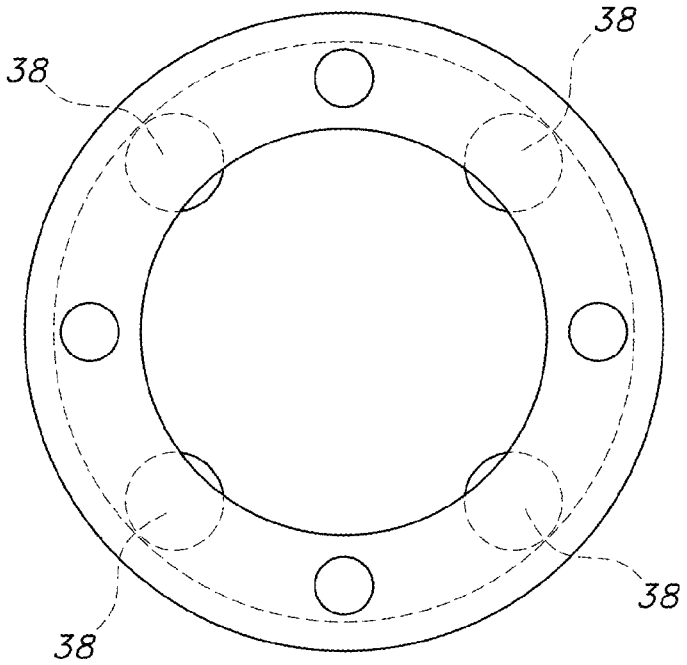
FIGS. 8E-D schematically show an example of an upper receiver coupling component in unlocked and locked configurations respectively.
Figure 8E:
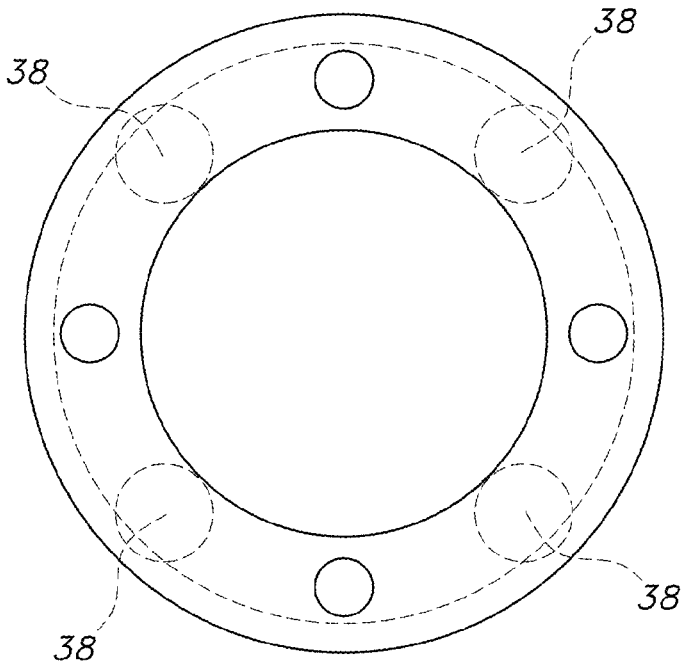

FIGS. 8A-C show the sliding lock collar 42 of FIG. 6 in further detail. The collar 42 has an opening extending through it with an innermost internal diameter of sufficient dimension to allow the collar 42 to fit over a portion of the body 36 in a sliding fashion. The collar 42 may be slid in a translational motion along the body 36 (e.g. straight along the body 36 without rotation of the collar 42 relative to the body 36).

The opening of collar 42 includes a recessed area terminating at shoulder 60 at one end of the collar 42. The recess is configured to contain the resilient element 40 shown in FIG. 6, with one end of the element 40 acting against shoulder 56 and the other end of the element 40 acting against shoulder 60 such that collar 42 is biased away from the shoulder 56 of body 36 towards the other end of the body 36.

The opening of collar 42 also includes a second recess at the other end of the collar 42. In this particular example, second recess is formed by ramped surface 62. When the collar 42 is biased away from the shoulder 56 of body 36, the ramped surface 62 acts on locking elements 38 to cause those elements to protrude into the opening 46 of body 36 (see FIG. 8D) in a locked position. When the collar 42 is pulled back against the bias of resilient element 40, the locking elements 38 are unlocked and can move out of the opening 46 (see FIG. 8E).

Figure 9A:
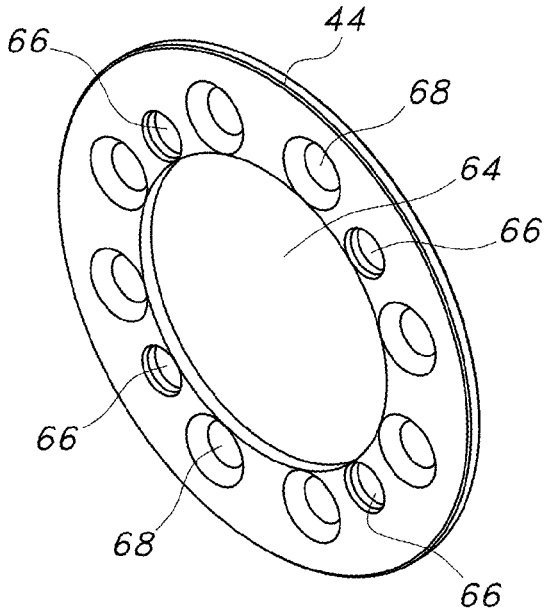
FIGS. 9A-C show an example of a face plate of an upper receiver coupling component.
Figure 9B:
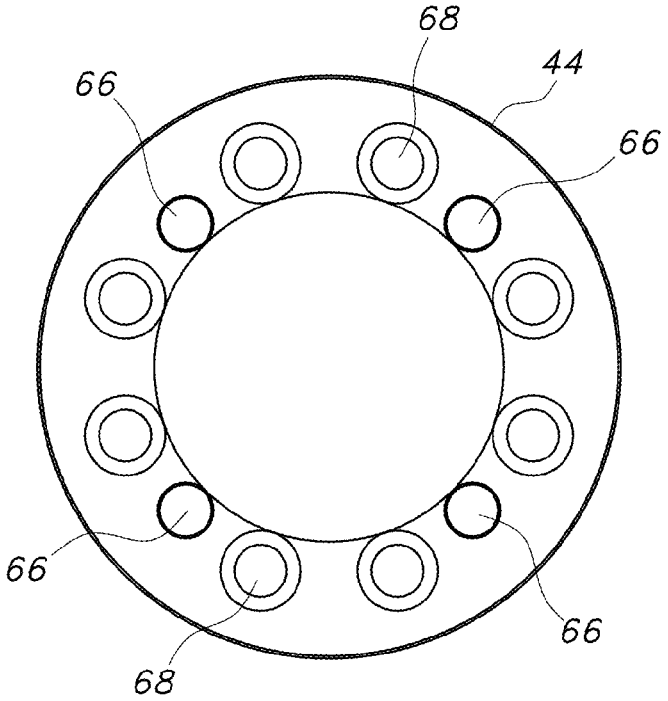
Figure 9C:
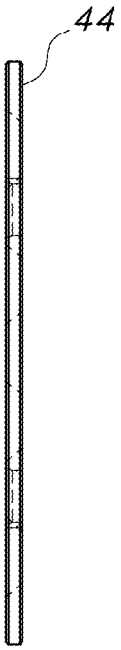

FIGS. 9A-C show the face plate 44 of FIG. 6 in more detail. The face plate includes a central opening 64 and tunnel portions 66 corresponding to the opening 46 and tunnels 54 of body 36. The outer diameter of the face plate 44 is of sufficient size so that when it is secured to the end of body 36 (e.g. using fasteners passing through fastener openings 68 in face plate 44 and into openings 58 in body 36), the face plate 44 limits the sliding movement of collar 42 away from the shoulder 56 of body 36.

Figure 10A:
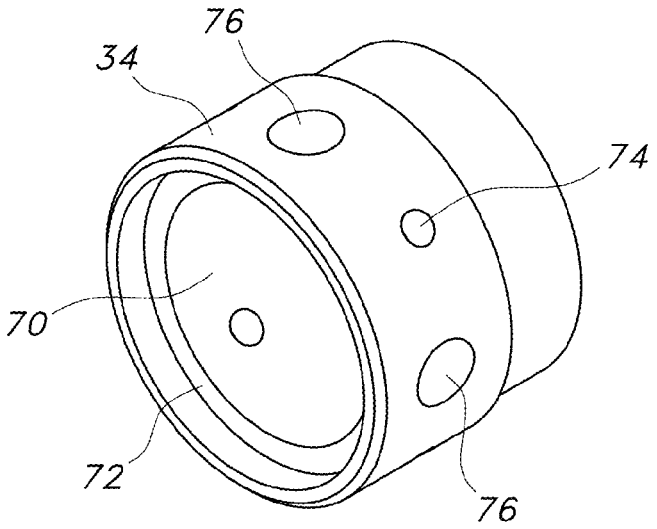
FIGS. 10A-C show an example of a barrel coupling component.
Figure 10B:
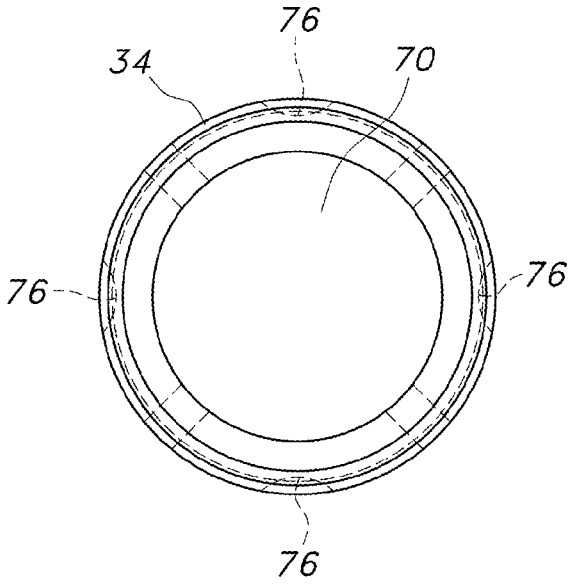
Figure 10C:
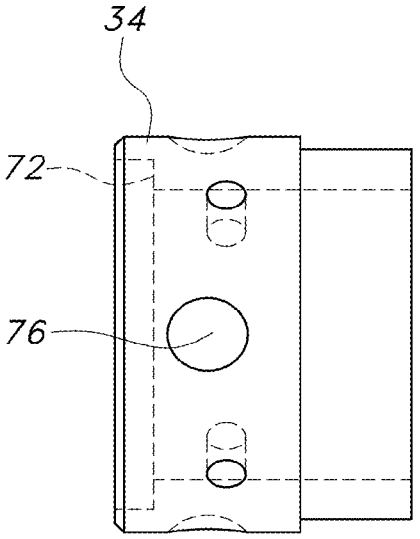

FIGS. 10A-C show the barrel coupling 34 of FIG. 5 in more detail. The barrel coupling 34 includes an opening 70 extending through it for receiving the barrel 12 of a firearm. In the particular example shown, the opening 70 includes a recessed area 72 that partially or entirely receives a ridge on the barrel 12 such that the barrel coupling 34 can be slid over the barrel 12 and receive the barrel ridge in the recessed area 72 such that the reference surface 22 (e.g. a rear surface of the barrel ridge) is flush with or slightly proud of the end of barrel coupling 34 (see FIG. 11). Recessed area 72 can also be seen in FIGS. 5C-E. Returning to FIGS. 10A-C, the barrel coupling 34 includes fastener openings 74 for receiving fasteners to further secure the barrel coupling in position on the barrel 12.

The barrel coupling 34 further includes several locking element receivers 76 spaced apart from one another and configured and located to receive portions of locking elements 38 during use. In the particular example shown, the locking elements receivers 76 are depressions in the outer surface of the barrel coupling 34. In the particular example shown, the spaced apart locking elements 38 and locking element receivers 76 help to resist rotation of the movement or forces of the upper receiver coupling 32 relative to the barrel coupling 34 when the components are locked together.

Figure 11:
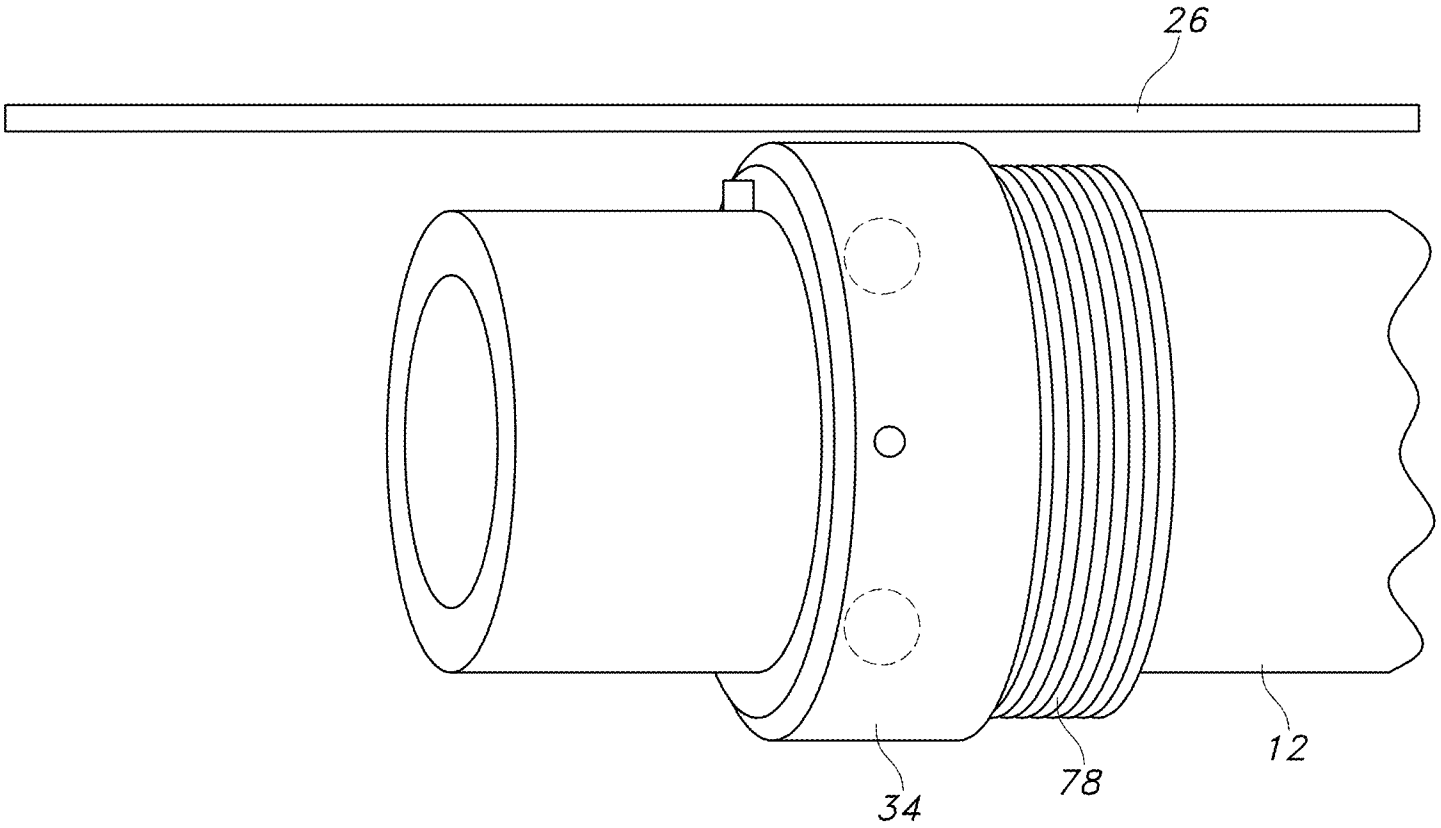
FIG. 11 schematically shows an example of a barrel coupling component mounted on a barrel.

The barrel coupling 34 further includes threads 78 on a portion of its outer surface. Threads 78 are not shown in FIG. 10 but are shown in FIG. 11. The pitch, thread angle, and other characteristics (e.g. major diameter, minor diameter)

of the threads 78 of barrel coupling 34 are the same or substantially the same as the pitch, thread angle, and other characteristics of the threads 18 of upper receiver 10. Because these thread characteristics are the same or substantially the same, barrel and/or handguard nuts or other connectors useable with the upper receiver threads 18 are also useable with the barrel coupling threads 78, meaning that handguards and other components that were usable with the upper receiver 10 can still be used with the firearm after installation of the upper receiver coupling 32 and barrel coupling 34 without requiring modification of those components or additional adaptors.

Figure 12:
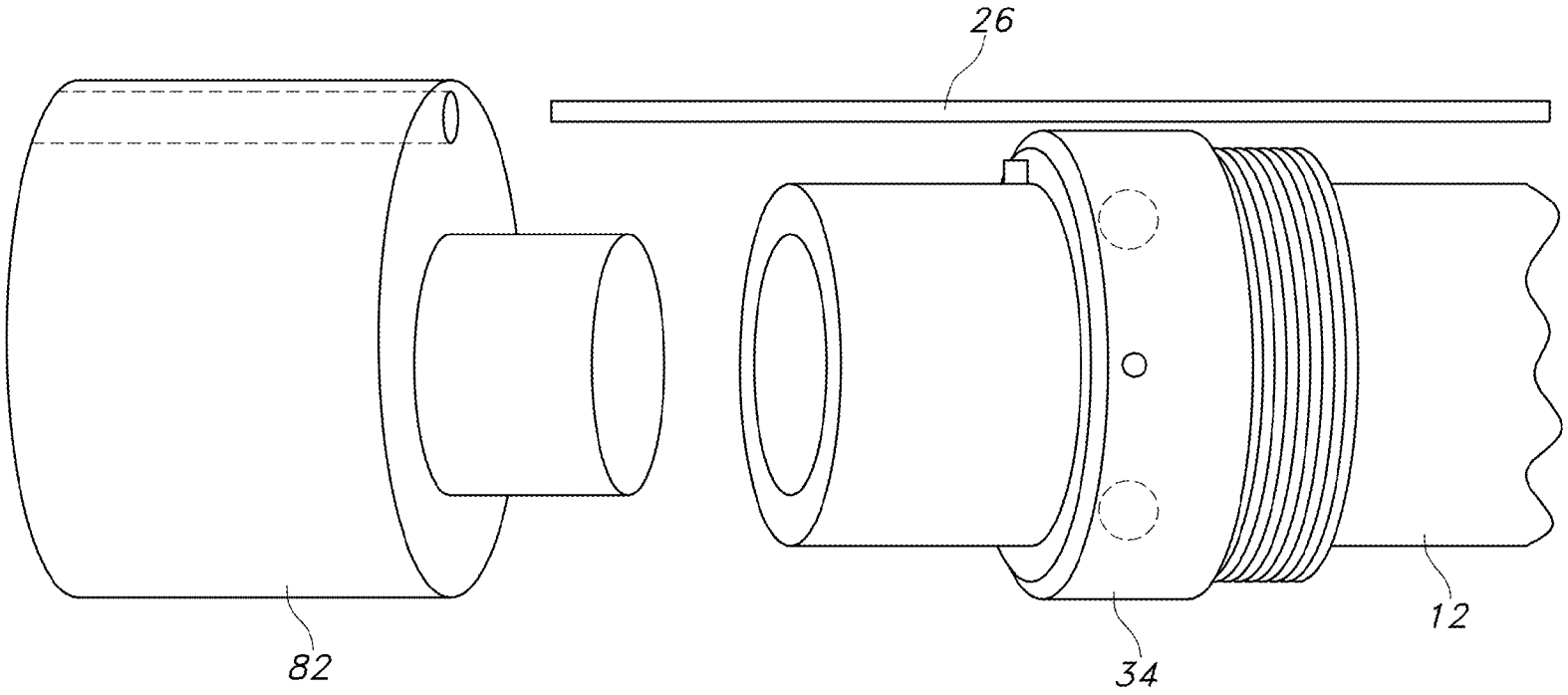
FIG. 12 schematically shows an example of a protective cap for a gas tube and barrel end.

FIG. 12 illustrates an example of a protective cap 82 for protecting the end of gas tube 26 (or a piston) when the firearm is disassembled.

Example Method of Installation

The following is one example of a method of installing the quick-take down coupling shown in FIGS. 5-12.

The upper receiver coupling 32 may be installed onto the upper receiver 10 by threading the upper receiver coupling 32 onto the upper receiver threads 18 to a desired torque and such that one of the tunnels 54 of the upper receiver coupling 32 is adequately aligned with the opening 24 in upper receiver 10. Set screws or other fasteners may be inserted into openings 50 in body 36 to further secure the upper receiver coupling 32 to the upper receiver threads 18.

The barrel coupling 34 may be installed onto the barrel 12 by sliding the coupling 34 onto the barrel until the barrel ridge is partially or entirely received in recessed area 72, with the reference surface 28 of the barrel ridge coplanar or just proud of the end of barrel coupling 34 and barrel pin 30 adjacent or proximate the barrel coupling 34. Set screws or other fasteners may be inserted into openings 74 in coupling 34 to further secure it to the barrel 12.

A handguard and/or barrel nut (e.g. 80 in FIG. 5A) may be threaded onto the barrel coupling 34 (in some instances, this may be done prior to securing the barrel coupling 34 to barrel 12). A gas tube (e.g. 26 in FIG. 5A) or piston may be installed on barrel 12, with an end of the gas tube or piston extending through an opening in the handguard / barrel nut 80, and a handguard (e.g. 14 in FIG. 5A) may be installed onto the handguard / barrel nut 80.

Example Method of Use

The following is one example of a method of using the quick-take down coupling shown in FIGS. 5-12 after installation onto a firearm.

Protective cap 82 may be removed from the end of gas tube 26 and barrel 12.

Sliding lock collar 42 may be slid using a translational motion (e.g. non-rotational) back towards the upper receiver 10 to an unlocked position that releases the locking elements 38 inside of the upper receiver coupling 32.

While the sliding lock collar 42 is held at the unlocked position, the barrel 12 may be inserted into the upper receiver 10. The barrel 12 is inserted until the barrel reference surface 28 contacts the upper receiver contact surface 22, with the barrel pin 30 seated in notch 20. During insertion of the barrel, gas tube 26 (or a piston) is also inserted through one of the tunnels 54 in the upper receiver coupling 32 and into opening 24 in the upper receiver 10. Once inserted, the locking element receivers 76 of the barrel coupling 34 are aligned with the locking elements 38 of the upper receiver coupling 32.

Once inserted, the sliding lock collar 42 is released such that resilient element 40 forces the sliding lock collar 42 back to a locked position, causing the locking elements 38 to engage the locking element receivers 76, securing the barrel 12 to the upper receiver 10.

The barrel 12 may be removed from the upper receiver 10 using the same procedure in reverse.

The foregoing description is by way of example only, and does not limit in any way the scope of the present invention, which is set forth in the following claims. Additions, deletions, substitutions, and other modifications to the systems and methods described above may be made without departing from the scope or spirit of the present invention.

The invention claimed is:

1. A method of assembly for a quick take-down firearm, the method comprising:

(a) sliding a sliding lock collar in a translational motion to an unlocked position to release a plurality of locking elements from a locked configuration, wherein the sliding lock collar is biased away from the unlocked position towards a locked position;

(b) while the sliding lock collar is held at the unlocked position, inserting a barrel of the quick take-down firearm into an upper receiver of the quick take-down firearm, wherein:

i. an upper receiver coupling is secured to threading of the upper receiver, the upper receiver coupling comprising a gas tube tunnel extending through a body of the upper receiver coupling;

ii. the barrel includes a barrel coupling; and iii. inserting the barrel into the upper receiver further comprises inserting a barrel pin of the barrel into a notch of the upper receiver threading, and inserting a gas tube of the barrel through the gas tube tunnel of the upper receiver coupling;

(c) after inserting the barrel into the upper receiver, releasing the sliding lock collar such that the sliding lock collar slides in the translational motion to the locked position to secure the upper receiver coupling to the barrel coupling.

2. The method of claim 1, wherein the translational motion is a non-rotational motion.

3. The method of claim 2, wherein inserting the gas tube comprises inserting the gas tube through one of a plurality of spaced gas tube tunnels extending through the upper receiver coupling.

4. The method of claim 3, wherein the plurality of spaced gas tube tunnels are rotationally spaced apart from one another.

5. The method of claim 4, wherein the plurality of spaced gas tube tunnels are rotationally offset from the plurality of locking elements.

6. The method of claim 2, wherein releasing the plurality of locking elements comprises releasing the plurality of locking elements from engagement with a plurality of separate locking element receivers.

7. The method of claim 6, wherein the plurality of separate locking element receivers comprise spaced apart depressions in the barrel coupling.

8. The method of claim 7, wherein the barrel coupling abuts a barrel ridge of the barrel.

9. The method of claim 8, wherein the barrel coupling further comprises threading engaged with threading of a handguard of the quick take-down firearm.

10. The method of claim 8, wherein, when the upper receiver coupling is secured to the barrel coupling, the barrel ridge of the barrel abuts a reference surface on the upper receiver.

11. The method of claim 1, further comprising, prior to inserting the barrel into the upper receiver, removing a protective covering from the gas tube.

12. The method of claim 1, wherein the barrel coupling is secured to the barrel.

13. A quick take-down component for a firearm, the quick take-down component comprising:

(a) an upper receiver coupling configured to be secured to an upper receiver threading of the firearm, the upper receiver coupling comprising a plurality of rotationally offset gas tube tunnels extending through the upper receiver coupling;

(b) a barrel of the firearm including a rifle barrel coupling; and (c) a sliding lock collar configured to be slid in a translational motion between a locked position and an unlocked position, the sliding lock collar biased to the locked position, wherein when the sliding lock collar is in the unlocked position the barrel of the firearm can be removed from and installed on the upper receiver, wherein when the sliding lock collar is in the locked position and the barrel is installed on the upper receiver the upper receiver coupling is secured to the rifle barrel coupling thereby securing the barrel to the upper receiver, wherein the translational motion is a non-rotational motion.

14. The quick take-down component of claim 13, wherein the rifle barrel coupling is further configured to be secured to a handguard threading of a handguard of the firearm.

15. The quick take-down component of claim 13, wherein the sliding lock collar extends around and slides on the upper receiver coupling.

16. The quick take-down component of claim 15, wherein, when the sliding lock collar is in the locked position, the sliding lock collar causes a plurality of separate locking elements of the upper receiver coupling to be held in a locked configuration.

17. The quick take-down component of claim 16, wherein the plurality of separate locking elements are rotationally offset relative to the plurality of rotationally offset gas tube tunnels.

18. The quick take-down component of claim 16, wherein the rifle barrel coupling comprises a plurality of separate locking element receivers configured to receive portions of the plurality of separate locking elements when the plurality of separate locking elements are in the locked configuration.

19. The quick take-down component of claim 16, wherein, when the sliding lock collar is in the unlocked position, the plurality of separate locking elements are released from the locked configuration.

20. The quick take-down component of claim 13, wherein the rifle barrel coupling is configured to be secured to the barrel of the firearm.

* * * * *